US008746007B2

(12) United States Patent
Hara et al.

(10) Patent No.: US 8,746,007 B2
(45) Date of Patent: Jun. 10, 2014

(54) HEAT CONVERTER FOR CONDENSATION AND REFRIGERATION SYSTEM USING THE SAME

(76) Inventors: Takao Hara, Kawaguchi (JP); Takashi Suzuki, Tokyo (JP)

( * ) Notice: Subject to any disclaimer, the term of this patent is extended or adjusted under 35 U.S.C. 154(b) by 1469 days.

(21) Appl. No.: 12/088,032

(22) PCT Filed: Sep. 25, 2006

(86) PCT No.: PCT/JP2006/318947
§ 371 (c)(1),
(2), (4) Date: Jun. 2, 2009

(87) PCT Pub. No.: WO2007/034939
PCT Pub. Date: Mar. 29, 2007

(65) Prior Publication Data

US 2009/0241591 A1 Oct. 1, 2009

(30) Foreign Application Priority Data

Sep. 26, 2005 (JP) ..... 2005-278949

(51) Int. Cl.
*F25B 1/10* (2006.01)

(52) U.S. Cl.
CPC ..... *F25B 1/10* (2013.01)
USPC ..... 62/498

(58) Field of Classification Search
CPC ..... F25B 1/00; F25B 39/00; F25B 39/04
USPC ..... 62/115, 197, 216, 222, 324.1, 324.6, 62/498, 507, 511, 527; 165/164, 165
See application file for complete search history.

(56) References Cited

U.S. PATENT DOCUMENTS 6,053,418 A * 4/2000 Guyer ..... 237/12.1
6,094,925 A * 8/2000 Arshansky et al. ..... 62/81

(Continued)

FOREIGN PATENT DOCUMENTS

JP 02201227 * 8/1990 ..... G01J 1/02
JP 10-259958 A 9/1998

(Continued)

OTHER PUBLICATIONS

Isobaric Process by Andrew Zimmerman Jones, at About.com Guide, http://physics.about.com/od/glossary/g/isobaric.htm.*

(Continued)

*Primary Examiner* — Frantz Jules
*Assistant Examiner* — Emmanuel Duke
(74) *Attorney, Agent, or Firm* — Westerman, Hattori, Daniels & Adrian, LLP

(57) ABSTRACT

To provide a heat converter for condensation that can be miniaturized and reduced in weight and can promote miniaturization, cost reduction and energy saving of a refrigeration system using the heat converter to thereby contribute to global environment conservation, and a refrigeration system using the heat converter.

A heat converter 30 for condensation which changes high-temperature and high-pressure refrigerant gas discharged from a compressor 1 of a refrigeration system to low-temperature refrigerant liquid is constructed by a isobaric cooling unit 3 for cooling the high-temperature and high-pressure refrigerant gas under isobaric change, a pressure-reducing liquefying unit 6 for liquefying gas refrigerant partially-liquefied in the isobaric cooling unit by a refrigerant acceleration phenomenon while the pressure and enthalpy are reduced, and a pressure-reducing and cooling unit 8 for cooling the refrigerant passed through the pressure-reducing and liquefying unit by the refrigerant acceleration phenomenon while the pressure and enthalpy are reduced.

9 Claims, 5 Drawing Sheets

(56) References Cited

U.S. PATENT DOCUMENTS

| | | | | |
|---|---|---|---|---|
| 6,253,567 | B1 * | 7/2001 | Imanari et al. | 62/434 |
| 2004/0216477 | A1 * | 11/2004 | Yamasaki et al. | 62/216 |

FOREIGN PATENT DOCUMENTS

| | | | | |
|---|---|---|---|---|
| JP | 2002-31435 | A | 1/2002 | |
| JP | 2002-122365 | A | 4/2002 | |
| JP | 2002122365 | * | 4/2002 | F25B 39/04 |
| JP | 2003-279168 | * | 10/2003 | F25B 1/00 |
| JP | 2003-279197 | A | 10/2003 | |
| JP | 2003279168 | * | 10/2003 | F25B 1/00 |
| JP | 2003279197 | * | 10/2003 | F25B 39/04 |
| KR | 1020030020251 | * | 1/2003 | F25B 29/00 |
| KR | 1020030020251 | * | 3/2003 | F25B 29/00 |

OTHER PUBLICATIONS

Plumbing Supply at http://www.plumbingsupply.com/coppertubing.html.*

Copper tube Material Information by GoodFellow at http://www.goodfellow.com/E/Copper-Tube.html.*

International Search Report of PCT/JP2006/318947, date of mailing Nov. 14, 2006.

Extended European Search Report dated Aug. 21, 2013, issued in corresponding European Patent Application No. 06810515.4.

* cited by examiner

HEAT CONVERTER FOR CONDENSATION AND REFRIGERATION SYSTEM USING THE SAME

TECHNICAL FIELD

The present invention relates to a heat converter for condensation and a refrigeration system using the same, and more particularly to a heat converter for condensing refrigerant used in a refrigeration system, and a refrigeration system using the heat converter.

BACKGROUND ART

Refrigeration systems used in apparatuses for cooling objects to be cooled such as a refrigerator, a freezer, a cooling apparatus, etc. are constructed by substantially the same constituent elements on the basis of the same principle irrespective of the scale or application of the system.

FIG. 4 is a diagram showing the construction of a general refrigeration system. As shown in FIG. 4, a general refrigeration system comprises a compressor 1, a condenser 13, a receiver tank 14, an expansion valve 15 and an evaporator 11 which are connected to one another through a refrigerant pipe 22, and refrigerant filled in this system transfers heat while circulated in a direction of an arrow 21 in the system. This circulation of the refrigerant is called as a refrigeration cycle. There is a case where a capillary tube is used in place of the expansion valve 15. In this case, the capillary tube is a very narrow tube of about 0.8 mm in inner diameter, for example.

Refrigerant gas is compressed in the compressor 1, and fed as high-temperature and high-pressure refrigerant to the condenser 13. In the condenser 13, the high-temperature and high-pressure refrigerant gas radiates heat, so that the refrigerant concerned is cooled to obtain intermediate-temperature refrigerant liquid. This intermediate-temperature refrigerant liquid is temporarily stocked in a receiver tank 14.

When the expansion valve 15 is opened, the intermediate refrigerant liquid enters the evaporator 11 which is reduced in pressure because the refrigerant gas thereof is sucked by the compressor 1. The intermediate refrigerant liquid is evaporated in the evaporator 11 and the temperature thereof is reduced by evaporation heat, so that the intermediate refrigerant liquid becomes low-temperature refrigerant liquid. The low-temperature refrigerant liquid absorbs heat from the surrounding thereof and thus cools the surrounding (targets to be cooled), and at the same time, it becomes low-temperature refrigerant gas. The low-temperature refrigerant gas is fed into the compressor 1, compressed again to become high-temperature and high-pressure refrigerant gas, and then circulated as high-temperature and high-pressure refrigerant gas.

As described above, the refrigerant is circulated in the refrigeration cycle while the heat obtained by cooling the surrounding targets in the evaporator 11 is radiated in the condenser 13 by the refrigerant.

In the evaporator 11, as shown in a phase change diagram of refrigerant shown at the lower side of the evaporator 11 of FIG. 4, most of the refrigerant is liquid in the neighborhood of the inlet of the evaporator 11, however, the refrigerant is gasified and the amount of the gasified refrigerant increases as it goes through the evaporator 11, so that the refrigerant is perfectly gasified in the neighborhood of the outlet of the evaporator 11. It is said that it is best in efficiency to perfectly gasify the refrigerant in the evaporator. However, in general, the refrigerant is perfectly gasified before the outlet of the evaporator 11 and the temperature further increases.

FIG. 5 is a diagram showing the construction of a refrigeration cycle which is generally used for a domestic refrigerator or the like at present. Refrigerant (chlorofluorocarbon (CFC), CFCs substitute or the like) which is sealingly filled in the refrigeration cycle is circulated in a direction of an arrow 21. First, refrigerant is compressed into high-temperature and high-pressure refrigerant gas by the compressor 1, and air-cooled in the large-size condenser 13 to be condensed and liquefied (roughly, a state of 90% liquid and 10% gas is kept). Then, the refrigerant is passed through the receiver tank (liquefying tank) 14, and expanded and reduced in pressure in the expansion valve 15 to become low-temperature and low-pressure refrigerant liquid. Thereafter, the low-temperature and low-pressure refrigerant liquid is fed to the evaporator 11 and heat-exchanged in the evaporator 11 (freezing temperature in a refrigerator or the like), whereby the refrigerant is evaporated and gasified to become low-temperature refrigerant gas, and returns to the compressor 1. The condenser 13 is provided with a cooling fan 13-1 to be enforcedly cooled as occasion demands in a special apparatus such as an industrial refrigerator or the like. In the condenser 13, the pipe through which the refrigerant flows and the air surrounding the pipe are brought into contact with each other to be heat-exchanged with each other, thereby cooling and liquefying the refrigerant. Therefore, it is preferable that the surface area of the pipe is broad and the occupational area of the evaporator 13 in the overall refrigeration system is increased.

In such a refrigeration system, the condenser 13 serving as a heat-source side heat exchanger must be designed to have a larger structure as compared with the evaporator 11 serving as a heat exchanger, and thus various studies have been made to miniaturize the condenser 13 so that the apparatus is designed to be compact. For example, Patent Document 1 discloses a refrigeration system in which a part of high-temperature and high-pressure refrigerant gas discharged from a compressor is cooled through a spiral tube by a cooling fan while the remaining high-temperature and high-pressure refrigerant gas discharged from the compressor is efficiently cooled by the former cooled refrigerant gas. Furthermore, Patent Document 2 discloses a system in which refrigerant discharged from a compressor is cooled through a spiral tube by a cooling fan, and further reduced in pressure and liquefied by another narrow tube.

Patent Document 1: JP-A-10-259958
Patent Document 2: JP-A-2002-122365

DISCLOSURE OF THE INVENTION

Problem to be Solved by the Invention

However, in the refrigeration system described in the Patent Document 1, the refrigerant discharged from the compressor is divided into two systems, and a heat exchanger having a dual structure is required to perform heat exchange. Therefore, this system has a problem that the structure of the heat exchanger is complicated. Furthermore, the system described in Patent Document 2 has a problem that pressure-reducing means which has not been provided to conventional refrigeration systems must be newly added to reduce the pressure in the narrow tube.

The present invention has been implemented to overcome the problems of the conventional refrigeration systems, and has an object to provide a heat converter for condensation that can be miniaturized and reduced in weight and promotes miniaturization, cost-reduction and energy saving of a refrigeration system using the heat converter, thereby contributing to global environment conservation (in this invention, portions containing the functions of a condenser, a receiver tank and an expansion valve of a conventional refrigeration system correspond to the heat converter for condensation), and a refrigeration system using the heat converter.

The present invention is a heat converter for condensation that changes high-temperature and high-pressure refrigerant gas discharged from a compressor of a refrigeration system to low-temperature refrigerant liquid, and is characterized by comprising: an isobaric cooling unit for cooling the high-temperature and high-pressure refrigerant gas under isobaric change; a pressure-reducing and liquefying unit for liquefying the refrigerant gas a part of which is liquefied in the isobaric cooling unit while reducing the pressure and the enthalpy of the refrigerant by an acceleration phenomenon of the refrigerant; and a pressure-reducing and cooling unit for cooling the refrigerant passed through the pressure-reducing and liquefying unit while further reducing the pressure and the enthalpy of the refrigerant by the acceleration phenomenon of the refrigerant.

Here, it is preferable that respective flow passages of the refrigerant in the isobaric cooling unit, the pressure-reducing and liquefying unit and the pressure-reducing and cooling unit are designed to be narrower in this order. An expansion unit may be provided between the isobaric cooling unit and the pressure-reducing liquefying unit. The flow rate of the refrigerant in the pressure-reducing and liquefying unit may be twice or more as high as the flow rate of the isobaric cooling unit.

Furthermore, an expansion unit may be provided between the pressure-reducing and liquefying unit and the pressure-reducing and cooling unit. The isobaric cooling unit may be a mini heat exchanger for liquefying the high-temperature and high-pressure refrigerant gas discharged from the compressor by 5 to 50 weight percents.

Furthermore, preferably, the pressure-reducing and liquefying unit may be a spiral tube that is formed by winding a narrow tube in a spiral form, and liquefies substantially all the gas refrigerant which is partially liquefied in the isobaric cooling unit. The pressure-reducing and cooling unit may be a spiral narrow tube comprising a plurality of spiral tubes that are individually formed by winding a narrow tube in a spiral form and arranged in parallel, the refrigerant liquefied in the pressure-reducing and liquefying unit being cooled in the pressure-reducing and cooling unit, thereby obtaining low-temperature refrigerant liquid. The spiral narrow tube may be connected to the pressure-reducing and liquefying unit through a branch tube, and further connected to an evaporator through a collecting tube.

A refrigeration system may comprise the heat converter for condensation, an evaporator for sucking low-temperature refrigerant liquid from the heat converter for condensation and heat-exchanging with a cool target to cool the cool target, a compressor that is connected to the evaporator through a suction pipe and compresses refrigerant which is partially or wholly vaporized in the evaporator, and a refrigerant pipe for connecting the compressor and the heat converter for condensation and also connecting the heat converter for condensation and the evaporator.

The isobaric cooling unit may be provided with a cooling fan, and the cooling fan may be actuated when the temperature of refrigerant gas discharged from the compressor is equal to a predetermined temperature or more. With respect to the cross-sectional area of the isobaric cooling unit, the cross-sectional area of the flow passage of the pressure-reducing and liquefying unit may be set to 40 to 50% and the cross-sectional area of the flow passage of the pressure-reducing and cooling unit may be set to 20 to 30%.

Effect of the Invention

The present invention is implemented by the above-described embodiments, and the following effects can be obtained. That is, according to the present invention, in consideration of the fact that the large-size design of the refrigeration system is mainly caused by the large size of the heat exchanger, the heat-exchange area for condensation can be dramatically reduced in size on the basis of the completion of a novel heat converter for condensation. Accordingly, the structure of the refrigeration system can be miniaturized by using this heat converter for condensation, excessive energy consumption in the industrial field can be reduced, and the capacity of the refrigeration system can be increased. Therefore, the present invention can tremendously contribute to the society and global environment conservation.

DESCRIPTION OF REFERENCE NUMERALS

Figure 1:
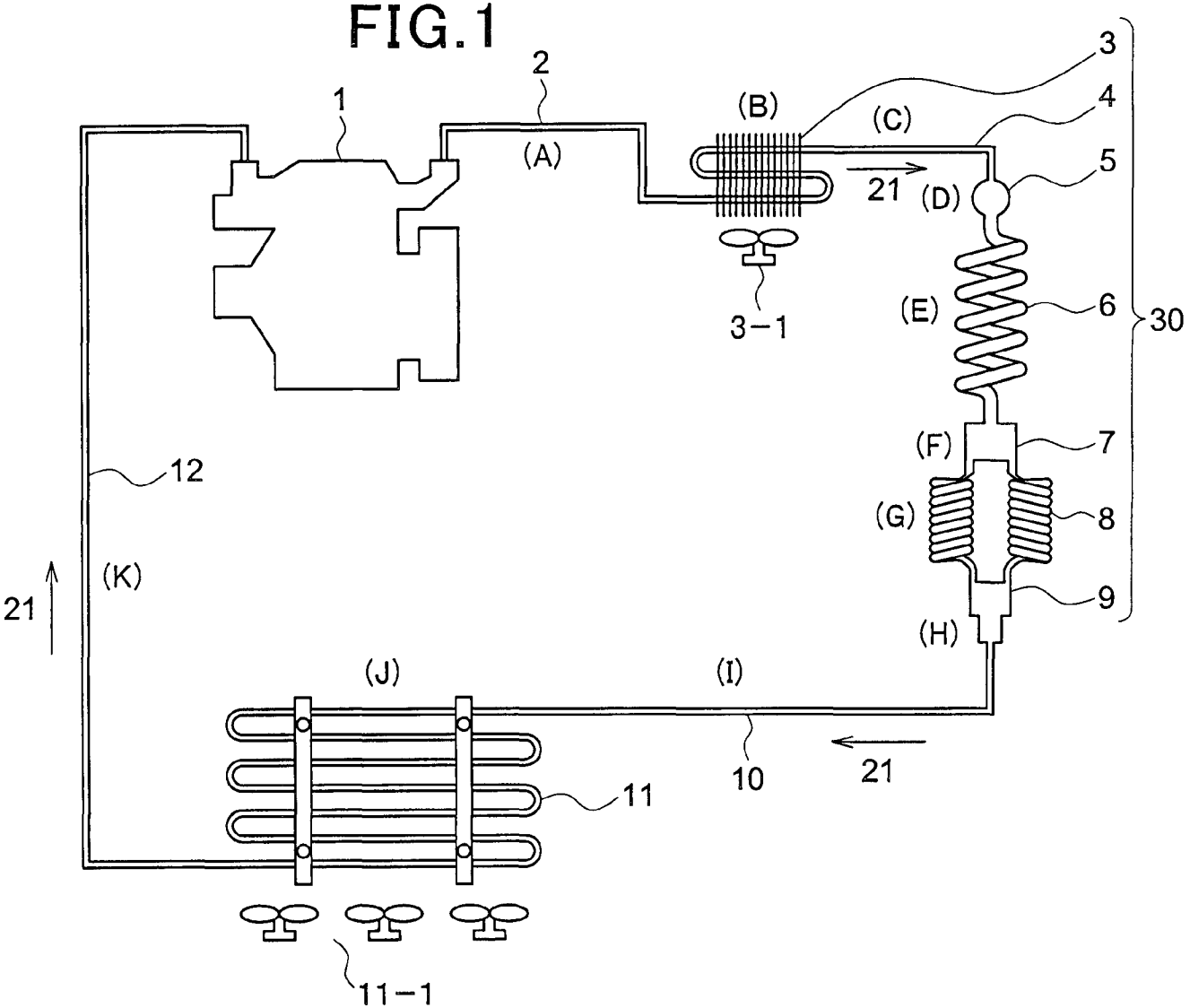
FIG. 1 is a diagram showing the construction of a first embodiment according to the present invention.

1 compressor
2, 4, 10 refrigerant pipe
3 mini heat exchanger (isobaric cooling unit)
3-1 mini fan
5 large short tube
6 spiral tube (pressure reducing and liquefying unit)
7 branch tube (expansion unit)
8 spiral narrow tube (pressure-reducing and cooling unit)
9 collecting tube (expansion unit)
11 evaporator
11-1 fan
12 suction pipe (refrigerant pipe)
13 condenser
13-1 fan
14 receiver tank

BEST MODES FOR CARRYING OUT THE INVENTION

Preferred embodiments according to the present invention will be described hereunder with reference to the accompanying drawings.

FIG. 1 is a diagram showing the construction of a refrigeration cycle of a refrigeration system using a heat converter 30 for condensation according to an embodiment of the present invention. Here, the terms "heat exchanger" and "heat converter" are distinctly used.

Figure 4:
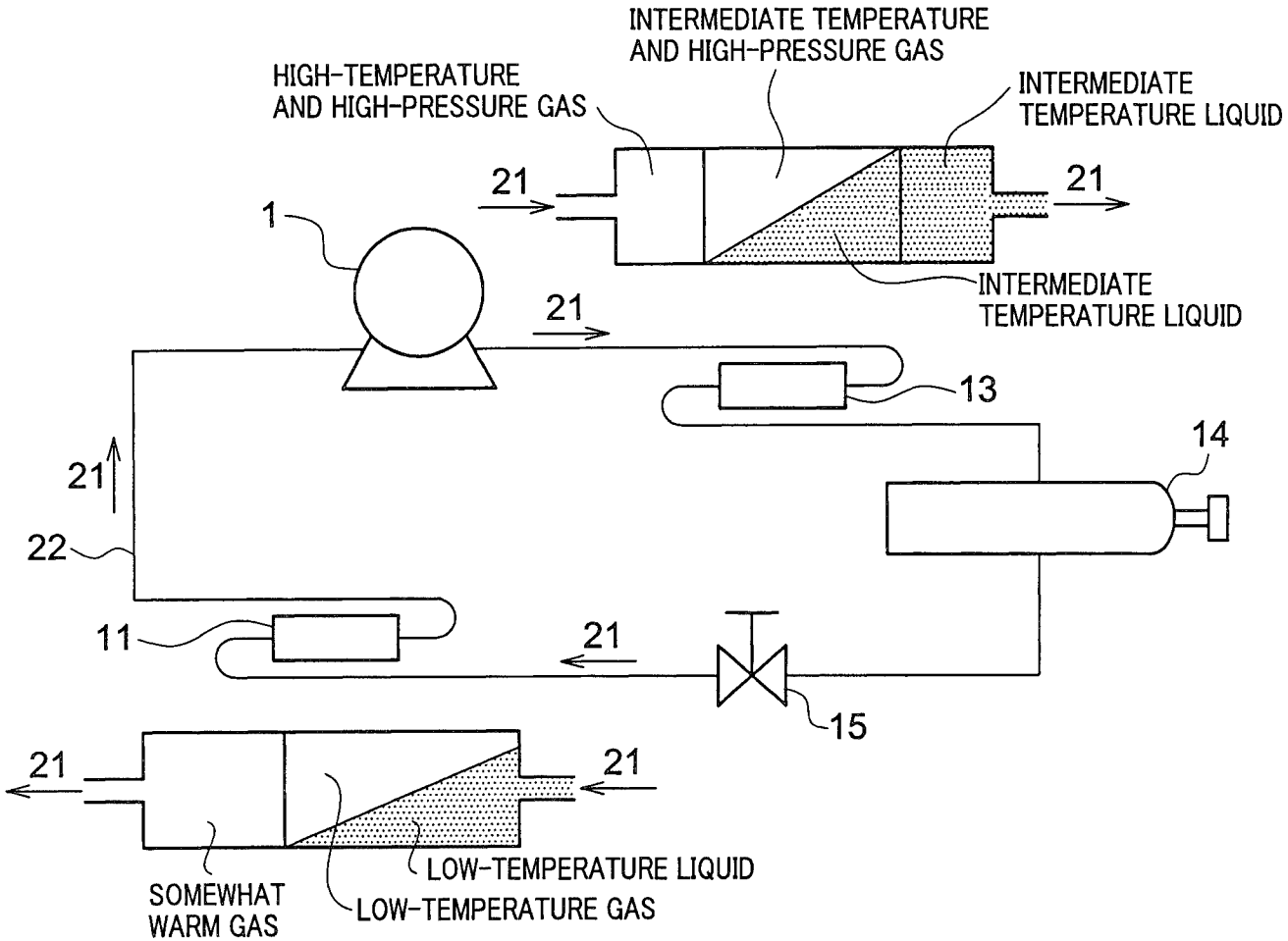
FIG. 4 is a diagram showing a general refrigeration system.

The refrigeration system according to this embodiment has a compressor 1, a mini heat exchanger (isobaric cooling unit) 3, a spiral tube (pressure-reducing and liquefying unit, primary tube) 6, a spiral narrow tube (pressure-reducing and cooling unit, secondary tube) 8 and an evaporator 11 as element units, and these element units are connected to one another through refrigerant pipes 2, 4 and 10, a suction pipe 12, a large short tube (expansion unit) 5, a branch tube (expansion unit) 7 and a collecting tube (expansion unit) 9. Accordingly, the refrigeration system implements a refrigerating function by circulating refrigerant in a direction of an arrow 21. The term "mini" of the mini heat exchanger 3 or a mini fan 3-1 described later means "compact", and it is used to clarify the feature of the present invention which can reduce the size of the condenser as compared with a conventional refrigeration system. The portions corresponding to the condenser 13, the receiver tank 14 and the expansion valve 15 of the conventional refrigeration system shown in FIG. 4 are constructed by the mini heat exchanger 3, the refrigerant pipe 4, the large short tube 5, the spiral tube 6, the branch tube 7, the spiral narrow tube 8 and the collecting tube 9 which constitute the condensation heat converter 30 in this embodiment.

The compressor 1 and the evaporator 11 have basically the same structure and function as those units used in existent refrigeration systems, and thus the detailed description of these units is omitted. Therefore, the heat converter 30 for condensation which is the feature of this embodiment will be described in detail.

Figure 2:
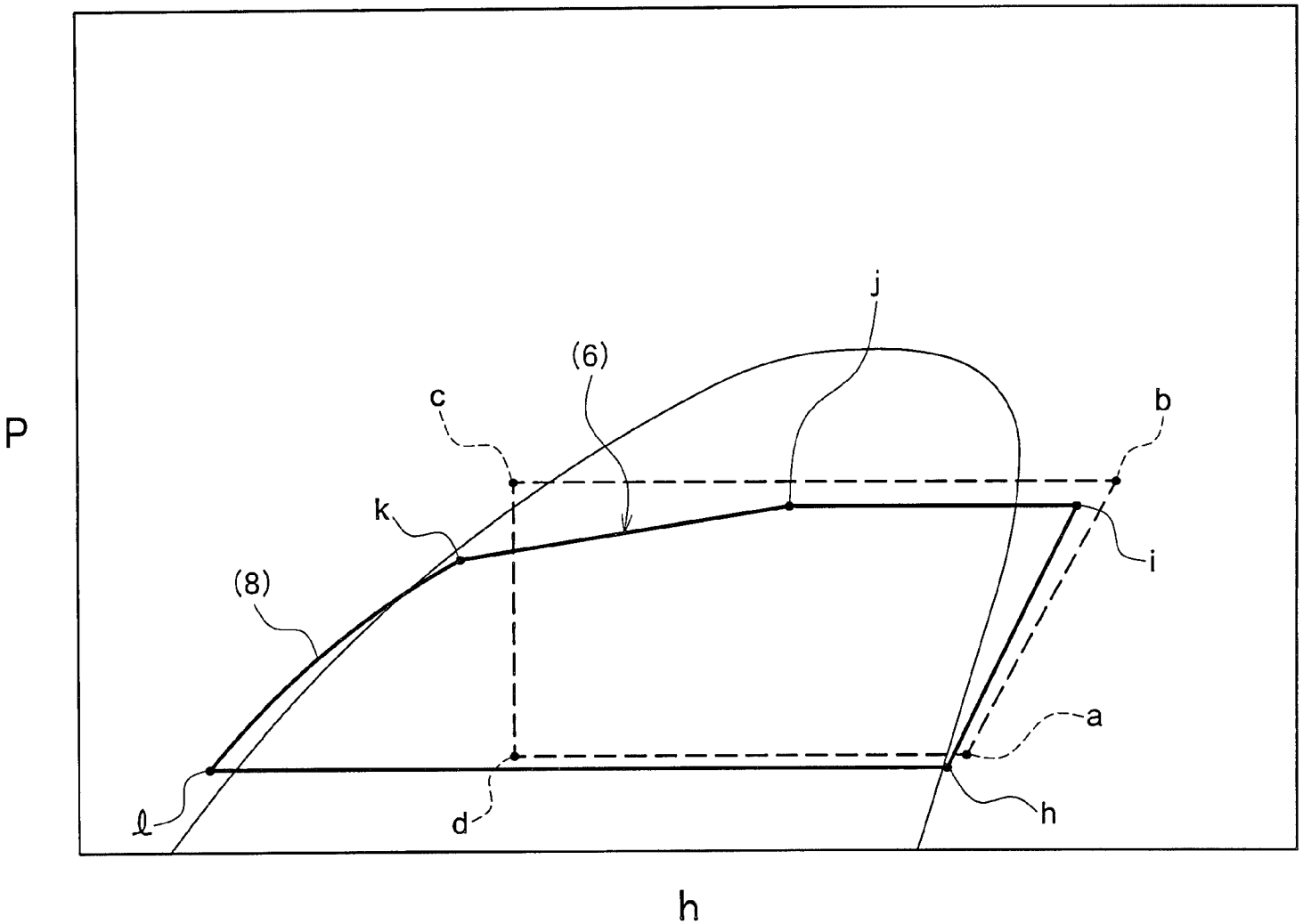
FIG. 2 is a P-h diagram of a refrigeration system according to the first embodiment of the present invention.

FIG. 2 is a P-h diagram of a refrigeration cycle of a refrigeration system using the heat converter 30 according to this embodiment. A broken line represents a conventional refrigeration cycle, and the cycle is completed by adiabatic compression (point a to point b) based on the compressor, condensation (point b to point c) caused by heat radiation under isobaric change by the condenser, enthalpic change (point c to point d) caused by a throttling phenomenon of the expansion valve and vaporization (point d to point a) caused by endotherm (heat absorption) under isobaric and isothermal expansion by the evaporator.

In this embodiment, gas refrigerant of high temperature (40° C. or more) and high pressure (0.6 MPa or more) is discharged from the compressor 1 (point h to point i), and then a part (5 to 50 weight percents) of the refrigerant is liquefied in the mini heat exchanger 3 constituting the heat converter 30 (point i to point j).

In FIG. 1, the mini heats exchanger 3 comprises a normal air-cooling type heat exchanger containing a refrigerant-flowing pipe and a radiation fan provided to the pipe. However, it is needless to say that the mini heat exchanger 3 is not limited to this type and it may be a water-cooling type or the like. The high-temperature and high-pressure gas discharged from the compressor is substantially wholly liquefied in the condenser of the conventional refrigeration system. However, the mini heat exchanger 3 of the heat converter 30 of this invention partially liquefies high-temperature and high-pressure gas, and thus the mini heat exchanger 3 can be designed to be very compact. As compared with a refrigeration system having the same type heat exchanger (condenser) and the same cooling capacity, the size of the mini heat exchanger according to this embodiment can be reduced to about one tenth of the conventional condenser.

The mini heat exchanger 3 is provided with a mini fan 3-1, and the mini fan 3-1 is actuated to enhance the heat exchange capacity under a predetermined operation state as described later.

The refrigerant which is partially liquefied in the mini heat exchanger 3 is passed through the refrigerant pipe 4 and the large short tube 5 and enters the spiral tube 6. From the viewpoint of the cross-sectional area, it is temporarily increased at the large short tube 5 with respect to the cross-sectional area of the mini heat exchanger 3, however, it is reduced to be smaller than the cross-sectional area of the mini heat exchanger 3 at the spiral tube 6.

Figure 3:
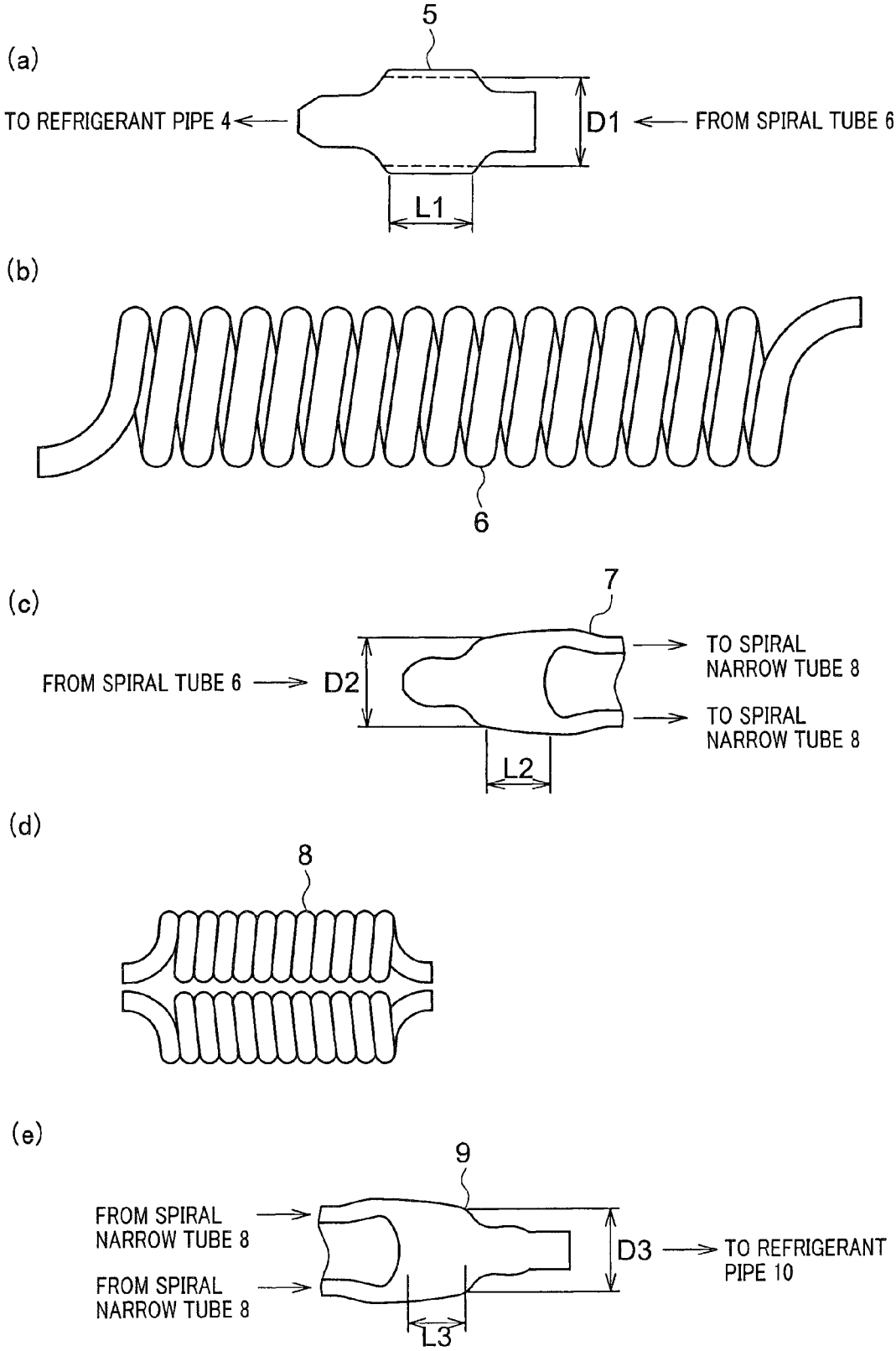
FIG. 3 *a* to *e* are plan views showing main constituent elements constituting a heat converter for condensation.

FIG. 3 is a plan view showing the shapes of the large short tube 5, the spiral tube 6, the branch tube 7, the spiral narrow tube 8 and the collecting pipe 9.

As shown in FIG. 3(*a*), the large short tube 5 is designed in a cylindrical shape so that the length L1 of the center thick portion is set to 10 to 50 mm and the inner diameter D1 is set to 8 to 20 mm. Both the ends of the large short tube 5 are connected to the refrigerant pipe 4 and the spiral tube 6. Accordingly, the large short tube 5 is designed in a cylindrical shape so as to have such a dimension that the refrigerant pipe 4 and the spiral tube 6 can be inserted into and connected to both the ends of the large short tube 5. The inner diameter D1 at the center thick portion is preferably set to be larger than the inner diameters of the refrigerant pipe 4 and the spiral tube 6.

As shown in FIG. 3(*b*), the spiral tube 6 is constructed by winding a narrow tube in a spiral form. The inner diameter and the number of turns thereof are determined in accordance with various specifications such as the refrigeration capacity, etc. of the refrigeration system. It is permissible that the inner diameter ranges from 2 to 150 mm, preferably it ranges from 2 to 50 mm and substantially most preferably ranges from 3 to 8 mm. For example, In the case of a refrigerating machine of about 2000 cal/h using Freon refrigerant R134*a*, the inner diameter of the narrow tube is set to 5 mm, the number of turns of the narrow tube is set to 23, the diameter of the spiral is set to 30 mm, and the length of the narrow length is set to 2.3 mm. The inner diameters of the refrigerant pipes 2, 4 are set to 7.7 mm, and the inner diameters of the refrigerant pipe 10 and the suction tube are set to 10.7 mm.

When the partially liquefied refrigerant enters the spiral tube 6, the refrigerant is accelerated by the suction action, etc. of the compressor 1 (called as a refrigerant acceleration phenomenon), so that the pressure is reduced and also the enthalpy is reduced. Accordingly, the liquefaction amount is increased and thus almost all of the refrigerant is liquefied, and intermediate-pressure (0.4 to 0.6 MPa) liquid refrigerant is obtained at the outlet of the spiral tube 6 (point j to point k in FIG. 2). It is estimated that the main factor of reducing the temperature in the spiral tube 6 resides in that the enthalpy of the refrigerant as thermal energy is converted to velocity energy in the spiral tube 6, so that the enthalpy of the refrigerant is reduced and thus a static temperature reduction phenomenon occurs. That is, the spiral tube 6 serves as an energy conversion device for converting enthalpy to velocity energy. It is desired that the flow rate of the refrigerant in the spiral tube 6 is set to be twice or more as high as the flow rate of the refrigerant in the mini heat exchanger 3.

In this construction, the pressure-reducing and liquefying unit is constructed by the spiral tube 6 which is wound in a spiral form. However, it is not limited to the spiral tube, but it may be a meandering tube, a straight pipe or the like insofar as it can liquefy almost all of gas refrigerant while reducing the pressure and the enthalpy of the refrigerant. In this case, it is desired that proper throttling means is interposed at the inlet of the meandering tube or the straight pipe, or at plural places in the tube or pipe. In any case, almost all of the gas refrigerant is liquefied by the means other than heat radiation, that is, the conversion of enthalpy to velocity energy in the pressure-reducing and liquefying unit.

The refrigerant which becomes the intermediate-pressure liquid refrigerant in the spiral tube 6 passes through the branch tube 7 and enters the spiral narrow tube 8. As shown in FIG. 3(*d*), the spiral narrow tube 8 is designed by winding a narrow tube in a spiral form like the spiral tube 6. The inner diameter of the spiral narrow tube 8 is set to be smaller than the inner diameter of the spiral tube 6. For example, when the inner diameter of the spiral tube 6 is set to 3 to 8 mm, it is desired that the inner diameter of the spiral narrow tube 8 is set to 1.2 to 3 mm. In this embodiment, two spirally wounded narrow tubes are connected to each other in parallel. However, three or more narrow tubes may be connected to one another in parallel, or only one spiral narrow tube may be provided. Furthermore, two spiral narrow tubes which are different in winding direction may be connected to each other in series, or another pair of series-connected spiral narrow tubes may be further connected to the above pair in parallel. It is preferable that the refrigerant-passing cross-sectional area of the spiral narrow tube 8 (when plural spiral narrow tubes are connected in parallel, the total of the cross-sectional areas of the plural spiral narrow tubes) is smaller than the cross-sectional area of the spiral tube 6. By reducing the cross-sectional area, the refrigerant is spin-rotated and thus accelerated in the spin narrow tube 8, so that the pressure is reduced and the cooling effect is enhanced. For example, in the case of a refrigerating machine of about 2000 cal/h, two spiral narrow tubes in which the inner diameter of the narrow tube is set to 2.5 mm, the number of turns is set to 19 turns, the diameter of the spiral is set to 15 mm and the length of the narrow tube is set to 0.72 m are connected to each other in parallel.

As shown in FIG. 3(*c*), the branch tube 7 branches refrigerant discharged from one spiral tube 6 into the two parts of the spiral narrow tube 8, and it is designed in a substantially cylindrical shape so that the length L2 of the main part (thick portion) of the branch tube 7 is set to 10 to 50 mm and the inner diameter D2 thereof is set to 10 to 20 mm. Both the ends of the branch tube 7 are designed in a cylindrical shape so as to have such a dimension that the spiral tube 6 and the spiral narrow tube 8 can be inserted into and connected to both the ends of the branch tube 7. In this embodiment, the spiral narrow tube 8 comprises two narrow tubes, and thus the branch pipe 7 has two connection holes at the connection side thereof to the spiral narrow tube 8. The number of the connection holes is made coincident with the number of narrow tubes constituting the spiral narrow tube 8.

For example, it is preferable that the inner diameter D2 is set to be larger than the inner diameter of each of the spiral tube 6 and the spiral narrow tube 8.

When nearly liquefied refrigerant enters the spiral narrow tube 8, the refrigerant is accelerated by the suction action, etc. of the compressor 1 (the refrigerant acceleration phenomenon), and thus the liquefied refrigerant is cooled while the pressure and the enthalpy are reduced. At the outlet of the spiral narrow tube 8, the refrigerant is reduced in pressure and cooled, and it becomes low-temperature liquid, so that the pressure is lowered and the refrigerant becomes low-pressure (0.4 MPa or less) liquid (point k to point 1 in FIG. 2). As shown in FIG. 2, the state of the refrigerant in the spiral narrow tube 8 varies along the saturated liquid line L.

It is also estimated that the main factor of reducing the temperature in the spiral narrow tube 8 resides in that the enthalpy of the refrigerant as thermal energy is converted to the velocity energy and thus the enthalpy is reduced, so that the static temperature reduction phenomenon occurs as in the case of the temperature reduction in the spiral tube 6. That is, as in the case of the spiral tube 6, the spiral narrow tube 8 also serves as an energy conversion device for converting enthalpy of refrigerant to velocity energy of the refrigerant.

In the design of this refrigeration system, it is desired that the flow rate of refrigerant in the spiral narrow tube 8 is twice or more as high as the flow rate of the refrigerant in the mini heat exchanger 3 and also equal to or higher than the flow rate of the refrigerant in the spiral tube 6.

In this construction, the spiral narrow tube 8 is not limited to the spiral shape, and it may be a meandering tube, a straight pipe or the like insofar as it can cool liquid refrigerant while the pressure and the enthalpy of the refrigerant are reduced. In this case, it is desired that proper throttling means is interposed at the inlet of the meandering tube or the straight pipe, or at plural places in the tube or pipe. In any case, the liquid refrigerant is cooled by the means other than heat radiation, that is, the conversion of enthalpy to velocity energy.

The refrigerant which is changed to the low-temperature liquid in the spiral narrow tube 8 is passed through the collecting tube 9 and the refrigerant pipe 10 and then fed to the evaporator 11. In the evaporator, the refrigerant is evaporated by endotherm under isobaric and isothermal expansion (point 1 to point h in FIG. 2), whereby the cycle of FIG. 2 is completed.

In the heat converter 30 for condensation in this cycle, a part (5 to 50 wt %) of the refrigerant is liquefied (joint i to point j) in the isobaric cooling unit (mini heat exchanger 3), the refrigerant is accelerated in the pressure-reducing and liquefying unit (spiral tube 6) so that the gas refrigerant of the partially liquefied refrigerant is substantially wholly liquefied (point j to point k) while the pressure and the enthalpy of the refrigerant are reduced, and the refrigerant is accelerated in the pressure-reducing and cooling unit (spiral narrow tube 8) so that the substantially liquefied refrigerant is super-cooled (point k to point 1) while the pressure and the enthalpy of the refrigerant are reduced. Therefore, COP (Coefficient Of Performance) of the refrigeration cycle is enhanced. Furthermore, the pressure of the refrigerant is reduced in the heat converter 30 for condensation, and thus it is unnecessary to provide a pressure reducing mechanism such as a narrow tube (in general, a capillary tube of about 0.8 mm in inner diameter), an expansion valve or the like, so that the refrigeration cycle can be simplified. Still furthermore, in the pressure-reducing and liquefying unit (spiral tube) 6 and the pressure reducing and cooling unit (spiral narrow tube 8), the enthalpy of refrigerant as thermal energy is converted to the velocity energy to thereby reduce the enthalpy of the refrigerant, and thus the phenomenon of the static temperature reduction occurs. Therefore, as compared with the heat-radiation case, the heat converter can be more miniaturized.

In this embodiment, the heat converter 30 for condensation is constructed by the isobaric cooling unit (mini heat exchanger 3), the pressure-reducing and liquefying unit (spiral tube 6) and the pressure-reducing and cooling unit (spiral narrow tube 8), however, the pressure-reducing and liquefying unit (spiral tube 6) may be constructed by a plurality of spiral tubes which are connected to one another in series. In this case, at the point j to the point k of FIG. 2, a cycle line having plural crook points is obtained.

As shown in FIG. 3(*e*), the collecting tube 9 collects the refrigerant discharged from the two spiral narrow tubes 8 into the single refrigerant pipe 10. The collecting tube 9 is designed in a substantially cylindrical shape so that the length L3 of the main part (thick portion) thereof is set to 10 to 50 mm and the inner diameter D3 thereof is set to 8 to 20 mm. Both the ends of the collecting tube 9 which are connected to the spiral narrow 8 and the refrigerant pipe 10 are designed in a cylindrical shape so as to have such a dimension that the spiral narrow tube 8 and the refrigerant pipe 10 can be inserted into and connected to both the ends of the collecting tube 9. In this embodiment, the spiral narrow tube 8 are constructed by two narrow tubes, and thus the collecting pipe 9 has two connection holes at the connection side to the spiral narrow tube 8. However, the number of the connection holes is made coincident with the number of the narrow tubes constituting the spiral narrow tube.

For example, it is preferable that the inner diameter D3 is set to be larger than the inner diameter of each of the spiral narrow tube 8 and the refrigerant pipe 10.

The materials of the large short tube 5, the spiral tube 6, the branch tube 7, the spiral narrow tube 8 and the collecting tube 9 are metal having high thermal conductivity such as copper or the like.

Freon 134*a* ($CH_2FCF_3$) is used as the refrigerant as described above, however, the present invention is not limited to this material. Non-Freon refrigerant such as isobutene ($CH(CH_3)_3$) or the like may be used insofar as safety measures to flash ignition are taken.

The collecting tube 9, the branch tube 7 and the large short tube 5 are designed to be larger in inner diameter than the refrigerant pipe. The refrigerant is sucked by the compressor 1, and suffers an action like pulsation event every time it passes through these tubes. Each tube sucks refrigerant at the upstream side to the downstream side, and this accelerates the refrigerant. The refrigerant in the spiral tube 6 is sucked to the downstream side by the branch tube 7, and the refrigerant in the spiral narrow tube 8 is sucked to the downstream side by the collecting tube 9, so that the refrigerant suffers a sucking action. Accordingly, spin-rotation is applied to the refrigerant.

In this embodiment, the spiral narrow tube 8 can accelerate the refrigerant liquid flowing therethrough coming from the branch 7 by performing the accelerating function. The refrigerant is set to the low-temperature and low-pressure refrigerant liquid from the outlet of the spiral narrow tube 8, and absorbs heat in the evaporator 11 so that it becomes low-pressure gas-liquid mixture refrigerant (or may be completely vaporized). Thereafter, the refrigerant passes through the suction pipe 12 and then returns to the compressor as low-pressure gas-liquid refrigerant, and it can absorb the heat of the stator of the compressor.

Figure 5:
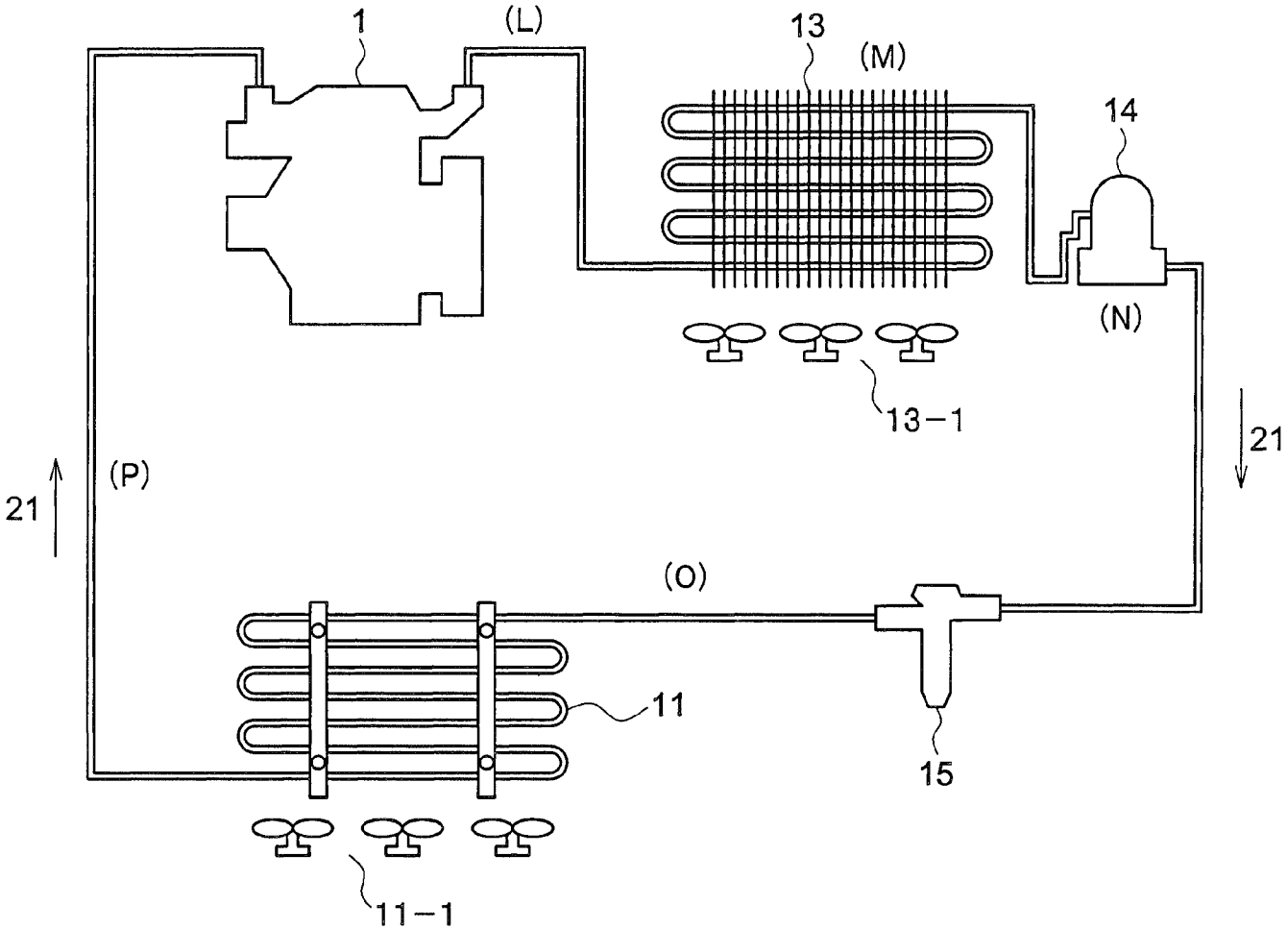
FIG. 5 is a diagram showing the construction of a conventional refrigeration system.

In the refrigeration cycle of this embodiment, the refrigerant is circulated at high speed by using the narrow tubes. Therefore, the amount of refrigerant may be reduced as compared with conventional apparatuses of the same scale, and thus the receiver tank 14 shown in FIG. 5 is unnecessary.

Alternatives for chlorofluorocarbon used generally as refrigerant are materials which do not destroy the ozone layer, but cause global warming. Accordingly, reduction of the use amount of these materials is effective to global environment conservation. Furthermore, it is preferable from the viewpoint of energy saving because the motive energy of the compressor can be reduced.

Furthermore, the spiral tube 6 and the spiral narrow tube 8 restricts the pressure, and thus the expansion valve 15 is also unnecessary.

As described above, in the refrigeration cycle of this embodiment, it is important how the spiral tube 6 and the spiral narrow tube 8 are reduced in pressure and the high-temperature and high-pressure refrigerant gas is efficiently changed to the low-temperature refrigerant liquid.

Accordingly, with respect to the large short tube 5, the spiral tube 6, the branch tube 7, the spiral narrow tube 8, the collecting tube 9 and the refrigerant pipes 2, 4, 10, 12 which are the important constituent elements of this invention, the respective conditions such as the materials of metal constituting the tubes, the length and diameter of the tubes, the pitch and the winding direction are set by repetitively conducting various tests under expected operation conditions and measuring examples of the temperature and pressure of refrigerant at each part of the refrigeration cycle.

Examples of the temperature and pressure of refrigerant at each part of a specific refrigeration cycle is shown below. The temperature and the pressure from (A) to (K) of FIG. 1 are as follows. Freon R134*a* was used as refrigerant.

(A) Intermediate-temperature and high-pressure refrigerant gas, 0.7 MPa, 40° C., (B) high-pressure gas-liquid refrigerant (90% gas, 10% liquid), 0.7 MPa, 38° C., (C) (D) high-pressure gas-liquid refrigerant, 0.7 MPa, 38° C., (E) intermediate-pressure refrigerant liquid, 0.5 MPa, 22° C., (F) intermediate-pressure refrigerant liquid, 0.5 MPa, 21° C., (G) low-pressure refrigerant liquid, 0.3 MPa, 8° C., (H) low-pressure refrigerant liquid, 0.07 MPa, −25° C., (I) low-pressure refrigerant liquid, 0.07 MPa, −25° C., (J) low-pressure gas-liquid refrigerant, 0.07 MPa, −25° C., (K) low-pressure gas-liquid refrigerant, 0.07 MPa, −15° C.

In this case, the dimension of each part of FIG. 1 is as follows.

The inner diameter of the refrigerant pipes 2, 4 is set to 7.7 mm (the cross-sectional area is 46.5 $mm^2$), the thick portion of the large short tube 5 is set to 30 mm in length and 10.7 mm in inner diameter (the cross-sectional area is 89.9 $mm^2$), the spiral tube 6 is formed by winding a narrow tube of 5 mm in diameter (cross-sectional area of 19.6 $mm^2$) and 2.3 m in length in a spiral form at 23 turns, the thick portion of the branch tube 7 is set to 30 mm in length and 13.8 mm in inner diameter (cross-sectional area of 149.5 $mm^2$), each of the two narrow tubes constituting the spiral narrow tube 8 is formed by winding a narrow tube of 2.5 mm in inner diameter (the cross-sectional area of one narrow tube is 4.9 $mm^2$ and the total cross-sectional area of the two narrow tubes is 9.8 $mm^2$) and 71 cm in length in a spiral form at 19 turns, the thick portion of the collecting tube 9 is set to 30 mm in length and 13.8 mm in inner diameter (the cross-sectional area is 149.5 $mm^2$), and the refrigerant pipe 10 and the suction pipe 12 are set to 10.7 mm in inner diameter (the cross-sectional area is 89.9 $mm^2$).

When the cross-sectional area of the isobaric cooling unit (refrigerant pipes 2, 4) is set as a reference, it is desired that the cross-sectional areas of the pressure-reducing and liquefying unit (spiral tube 6) and the pressure-reducing and cooling unit (spiral narrow tube 8) are gradually reduced in this order, and the cross-sectional area of the pressure-reducing and liquefying unit (spiral tube) 6 is set to 40 to 50% while the cross-sectional area of the pressure-reducing and cooling unit (spiral narrow tube 8) is set to 20 to 30%.

The materials of the large short tube 5, the spiral tube 6, the branch tube 7, the spiral narrow tube 8 and the collecting tube 9 are copper.

For reference, the respective temperature and pressure of (L) to (P) of the conventional refrigeration cycle shown in FIG. 4 are as follows. Freon R134*a* is used as refrigerant.

(L) high-pressure refrigerant gas, 0.95 MPa, 90° C., (M) high-pressure refrigerant liquid gas (90% liquid, 10% gas), 0.95 MPa, 48° C., (N) high-pressure refrigerant liquid gas, 0.95 MPa, 45° C., (O) low-pressure refrigerant liquid gas, 0.1 MPa, −10° C., (P) low-pressure refrigerant gas, 0.1 MPa, 15° C.

In the refrigeration cycle of this embodiment, the spiral tube 6 and the spiral narrow tube 8 are reduced in pressure by suction of the compressor 1. Accordingly, when an over-load is applied to the refrigeration cycle, the over-load is applied to the compressor 1. When a temperature sensor provided to the compressor 1 or a temperature sensor for measuring the temperature of the refrigerant gas discharged from the compressor 1 exceeds a predetermined temperature, a controller (not shown) judges an over-load, and the mini fan 3-1 is actuated to enhance the refrigerant liquefaction capability of the mini heat exchanger 3.

INDUSTRIAL APPLICABILITY

The heat converter for condensation according to the present invention or the refrigeration system using the same is applicable to any cooling apparatus. It is applicable to a domestic or commercial refrigerator-freezer, a cold air apparatus requiring no outdoor unit, a spot cooler having a small heat exhaust amount, a cold table requiring no cooler, an instantaneous cooler, a Freon liquefying and reproducing apparatus, etc.

The invention claimed is:

1. A heat converter for condensation that changes high-temperature and high-pressure refrigerant gas discharged from a compressor having a suction port of refrigerant in a refrigeration system to low-temperature refrigerant liquid, comprising:

an isobaric cooling unit for cooling the high-temperature and high-pressure refrigerant gas under isobaric change;

a pressure-reducing and liquefying unit for liquefying the refrigerant gas a part of which is liquefied in the isobaric cooling unit while reducing the pressure and the enthalpy of the refrigerant by an acceleration phenomenon of the refrigerant; and a pressure-reducing and cooling unit for cooling the refrigerant passed through the pressure-reducing and liquefying unit while further reducing the pressure and the enthalpy of the refrigerant along a saturated liquid line by the acceleration phenomenon of the refrigerant, and discharging the pressure-reduced and cooled refrigerant from an exit thereof, wherein respective flow passages of the isobaric cooling unit, the pressure-reducing and liquefying unit and the pressure-reducing cooling unit are designed to be narrower in inner diameter in this order, pressure of the pressure-reduced and cooled refrigerant at the exit of the pressure-reducing and cooling unit is substantially equal to pressure of the refrigerant at the refrigerant suction port of the compressor, and the isobaric cooling unit is a mini heat exchanger for liquefying 5 to 50 wt % of high-temperature and low-temperature refrigerant gas discharged from the compressor;

wherein the cross-sectional area of the flow passage of the pressure-reducing and liquefying unit is set to 40 to 50% and the cross-sectional area of the flow passage of the pressure-reducing and cooling unit is set to 20 to 30% with respect to the cross-sectional area of the flow passage of the isobaric cooling unit.

2. The heat converter for condensation according to claim 1, wherein flow rates of the pressure-reducing and liquefying unit and the pressure-reducing cooling unit are set to be twice or more as high as a flow rate of the isobaric cooling unit.

3. The heat converter for condensation according to claim 1, further comprising: an expansion unit provided between the isobaric cooling unit and the pressure-reducing liquefying unit.

4. The heat converter for condensation according to claim 1, further comprising: an expansion unit provided between the pressure-reducing liquefying unit and the pressure-reducing and cooling unit.

5. The heat converter for condensation according to claim 1, wherein the pressure-reducing and liquefying unit is a spiral tube that is designed in a spiral form and liquefying almost all of gas refrigerant which is partially liquefied in the isobaric cooling unit.

6. The heat converter for condensation according to claim 1, wherein the pressure-reducing and cooling unit is a spiral narrow tube comprising a plurality of spiral tubes each of which comprises a spirally-wound narrow tube, the plurality of spiral tubes being arranged in parallel, and the pressure-reducing and cooling unit cools the refrigerant liquefied in the pressure-reducing and liquefying unit to change the refrigerant to low-temperature refrigerant liquid.

7. The heat converter for condensation according to claim 6, wherein the spiral narrow tube is connected to the pressure-reducing and liquefying unit through a branch tube and also connected to an evaporator through a collecting tube.

8. A refrigeration system comprising:

the heat converter for condensation according to claim 1;

an evaporator for sucking low-temperature refrigerant liquid from the heat converter for condensation and heat-exchanging the low-temperature refrigerant liquid with a cooling target to cool the cooling target;

the compressor that is connected to the evaporator through a suction pipe and compresses refrigerant which is partially or wholly vaporized in the evaporator; and a refrigerant pipe through which the compressor and the heat converter for condensation are connected to each other and the heat converter for condensation and the evaporator are connected to each other.

9. The refrigeration system according to claim 8, wherein the isobaric cooling unit is provided with a cooling fan, and the fan is actuated when the temperature of refrigerant gas discharged from the compressor is equal to a predetermined temperature or more.

* * * * *